US005697838A

United States Patent [19]

Morris

[11] Patent Number: 5,697,838

[45] Date of Patent: Dec. 16, 1997

[54] APPARATUS AND METHOD TO OPTIMIZE FUME CONTAINMENT BY A HOOD

[75] Inventor: Robert H. Morris, Wharton, N.J.

[73] Assignee: Flow Safe Inc., Denville, N.J.

[21] Appl. No.: 658,033

[22] Filed: Jun. 4, 1996

[51] Int. Cl.[6] ..... B08B 15/02

[52] U.S. Cl. ..... 454/62; 454/61

[58] Field of Search ..... 454/56, 61, 62; 126/299 R, 299 D

[56] References Cited

U.S. PATENT DOCUMENTS

| | | | |
|---|---|---|---|
| 4,741,257 | 5/1988 | Wiggin . | |
| 4,785,722 | 11/1988 | Dollhopf et al. | 454/62 |
| 5,518,446 | 5/1996 | Jacob | 454/61 |

*Primary Examiner*—Harold Joyce

*Attorney, Agent, or Firm*—M. Lukacher

[57] ABSTRACT

A system for optimizing the flow of air through a fume hood by dynamically controlling the air flow to provide a stable vortex in the vortex chamber of the hood, the optimum condition for minimizing backflow of fume-laden air through the hood doorway. A highly-sensitive pressure sensor disposed at a critical location in the vortex chamber sidewall senses minute variations in vortex pressure indicative of turbulence and sends signals via a transducer to an analog controller which uses proportional integral and adaptive gain algorithms to formulate output signals to an actuator which adjusts dampers in the hood to change the airflow into the vortex. The system operates in feedback mode and seeks a minimum in the amplitude of the sidewall pressure variations, indicating that turbulence has been eliminated and that a stable vortex exists. The pressure sensor signals can also be directed to an alarm to signal an off-standard and potentially dangerous condition.

14 Claims, 8 Drawing Sheets

APPARATUS AND METHOD TO OPTIMIZE FUME CONTAINMENT BY A HOOD

DESCRIPTION

The subject invention relates to ventilated enclosures for containing and preventing the spread of vapors, such enclosures being commonly known as fume hoods, more particularly to fume hoods which are openable to permit access to the interior, which opening may permit inadvertent escape of fumes to the exterior of the hood, and most particularly to fume hoods having control over ingress velocity and volume of make-up air.

Fume hoods are well known in industrial and scientific installations where it is desirable to prevent the spread of volatile substances, particularly toxic substances, through the workplace, and to prevent inhalation of such substances by persons working with them. Hoods can range in size from units admitting only an operator's hands or arms to large units capable of admitting one or more persons and large equipment. Typically, a hood comprises an enclosure having an air exhaust system to draw unladen air into the hood and to discharge air and fumes at a predetermined, sometimes variable, rate from the interior of the hood to a safe discharge point remote from the hood. A closable opening in the enclosure, such as a vertically slidable door or sash, typically is provided to permit ingress of air and occasional human and equipment interaction with operations being conducted within the hood.

A common objective in use of fume hoods is the prevention of counter-flow leakage of fumes through the doorway when the door is open. One strategy is to increase air flow through the hood while the door is open, but this action can be counter-productive as increased airflow can cause increased turbulence within a hood which can actually cause puffs of fume-laden air to be expelled through the doorway. In addition, the air being admitted to a hood and then exhausted to the atmosphere may have been conditioned for human comfort at some expense, and a high-flow hood, therefore, can be wasteful of energy and very costly to operate.

U.S. Pat. No. 4,741,257 issued May 3, 1988 to Wiggin et al. discloses a control system which measures the air pressure inside and outside a hood and adjusts the flow of air into the hood to maintain a constant pressure difference. When the hood door or sash is opened or closed, the system increases or decreases the incoming air flow to rebalance the pressure differential to provide a constant velocity of air through the "face," or open area, of the hood regardless of the sash position. The assumption underlying this control system is that maintaining a constant air velocity through the face of the hood is the optimum control strategy. This assumption is not necessarily true because it fails to address what is the optimum pressure difference and therefore the optimum air flow through the hood to prevent backflow. The flow mandated by this system also can be wasteful of conditioned air. Tracer gas studies conducted by the inventor have shown that fume hoods are not inherently made safer by using variable volume fixed face velocity control, although energy can be saved through reduction in throughput volume. Fume hoods employing different designs and having different dimensions can have different optimum flow velocities and volumes, which are also subject to environmental conditions including absolute and varying pressure outside the hood, air currents and activity in front of the hood, loading within the hood, and the temperature of make-up air entering the hood.

A typical top-exhaust hood has basically two zones, a lower face-velocity working chamber and above it a second chamber which may contain a vortex which supplies the exhaust system. I have found that the strength and stability of the vortex are of substantially greater importance in controlling backflow than is the face velocity of air entering the hood. When air flow is too low, the vortex is unstable and poorly defined, and backflow can occur through an open sash. When air flow is too high, the vortex may be deformed or destroyed and replaced by turbulent air movement which allows plumes of fume-laden air to be ejected through the hood face. When air flow is properly adjusted, a smooth vortex is established in the upper chamber which efficiently captures fumes from the lower chamber, providing for their conveyance to the exhaust outlet and preventing backflow of fumes through the face.

At a critical position on the sidewall of the vortex chamber, determinable by a method described hereinbelow, a critical pressure difference exists between the vortex chamber and the exterior of the hood. The pressure difference varies with the volume of air flowing through the hood and the with percent open area of the face. A stable vortex is laminar in flow, and under these conditions a sensor placed at the critical position in the vortex detects minimal pressure fluctuations between the interior of the vortex chamber and the exterior of the hood. This condition represents the optimum air flow through the hood and the optimum pressure difference. Under unstable vortex conditions, however, the sensor will detect the minute pressure fluctuations associated with turbulent or chaotic flow through the upper chamber. The dynamic control system of the subject invention uses feedback sensing of pressure variation to vary the flow of make-up air into the vortex chamber from the lower chamber to establish a stable vortex and thereby to minimize the sensed pressure changes.

Measurement of the vortex pressure at the boundary wall requires a differential transducer capable of measuring in real time velocity pressures in the order of 0.000015 inches of water. Known mechanical differential pressure deflection sensors are inadequate since the mass and travel distance of a membrane are too great and the reaction time is too slow. Known hot wire resistance thermal devices (RTD's) or thermistors cannot provide sufficient gain in the first stage for real time measurement.

It is a principal object of the invention to provide improved apparatus and method for minimizing turbulence in the vortex chamber of a fume hood.

It is a further object of the invention to provide improved control means to minimize the counter-flow escape of fume-laden air from a fume hood.

It is a still further object of the invention to provide an improved fast-response sensor for detecting pressure differences as low as 0.000015" wc or less.

It is a still further object of the invention to provide improved apparatus and method for maximizing the fume-containing performance of a fume hood while minimizing the throughput of make-up air.

Briefly described, a System in accordance with the invention has a fast-response differential pressure sensor positioned at a critical and determinable location in a wall of the vortex chamber above the working chamber. In operating mode, there is a small, continuous flow of air through the sensor into the vortex chamber from outside the hood because of lower pressure in the vortex chamber. When the system detects very small and very rapid variations in pressure in the vortex chamber, it infers an instability in the vortex and signals an actuator to adjust one or more dampers to change the airflow into and out of the vortex to reduce turbulence and stabilize the vortex. The sensor may also be used in a non-control mode as part of an alarm system for warning a hood operator of a potentially hazardous backflow condition.

The sensor includes a pair of matched linear thermal Zener diodes in opposite legs of a resistance bridge which functions as a signal transducer. One of the diodes is connected to a heat sink to mechanically unbalance the matched sensors, providing a fixed heat loss bias between the sensors which prevents electronic drift. The bridge includes a two-stage output amplifier. The sensors are shielded by identical pieces of metal tubing, which are isolated from the diodes by rubber spacers, and respond differentially to cooling from air passing over the thermal diodes. Air velocities are calibrated to be directly indicative of variation in pressure differences between the inside and the outside of the hood. For example, a bridge output of 2 volts can correspond to an amplitude variation of 0.000015" wc.

The linear diodes in combination with the fixed heat differential mechanical structure allow very tiny pressure changes to be measured at the vortex chamber wall which show the degree of perfection and stability of the vortex. A novel entrance nozzle and aerodynamic pickup shape reject unwanted energy waves of similar magnitude from noise sources outside the hood, such as building HVAC pulsations and wind.

There is no universal optimum location for the sensor for all hoods. I have derived a procedure and a mathematical formula to determine the optimum location for any given hood, based upon the height and depth of the vortex chamber and the ratio of the measured face air velocities at two different size openings of the face.

The bridge including the sensors and amplifiers is a vortex differential pressure transducer which transmits real-time signals to a dedicated analog controller having proportional integral and adaptive gain algorithms. The output of the controller is sent to an actuator which varies the position of a bypass air damper in the hood to vary the volume of make-up air entering the vortex. The control system seeks a damper position in which minimum pressure variation is experienced by the sensor, indicating the presence of a stable vortex. A second damper at the exit slot from the vortex chamber may also be manipulated by the control system to assist in obtaining the proper air flow through the vortex. If no minimum is obtainable within the range of action of the control dampers, the output signal activates a hood exhaust damper to throttle the exhaust fan and bring the system within control of the control dampers.

This technique is especially useful in controlling multiple fume hoods which are ganged on a single exhaust system. It is impossible to adjust a central exhaust system to optimally serve multiple hoods at various locations within a building. The discovery of how the vortex can be optimized by manipulating dampers within the hood to protect the fume hood user is very important advance in operator safety. The system can be adapted to provide an alarm of an unsafe condition if for any reason the vortex cannot be made stable by manipulating the exhaust damper and the bypass damper. This alarm is based not on face velocity as disclosed in the prior art but on fume hood capture quality. This technique also saves energy since a low face velocity can be used when the face area of the hood is small (door nearly closed).

The foregoing and other objects, features, and advantages of the invention, as well as presently preferred embodiments thereof, will become more apparent from a reading of the following description in connection with the accompanying drawings in which.

Figure 10:
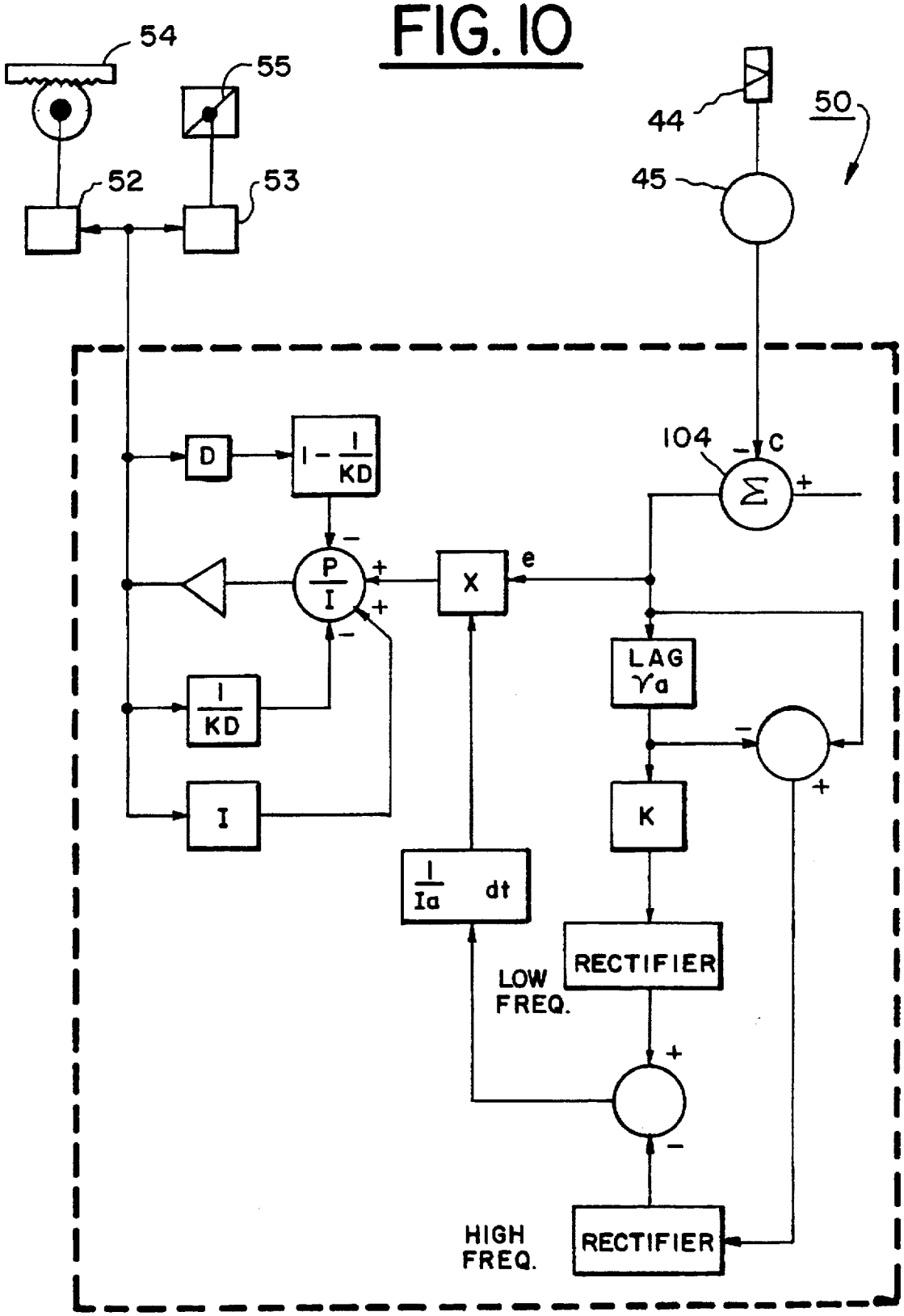
Figure 11:
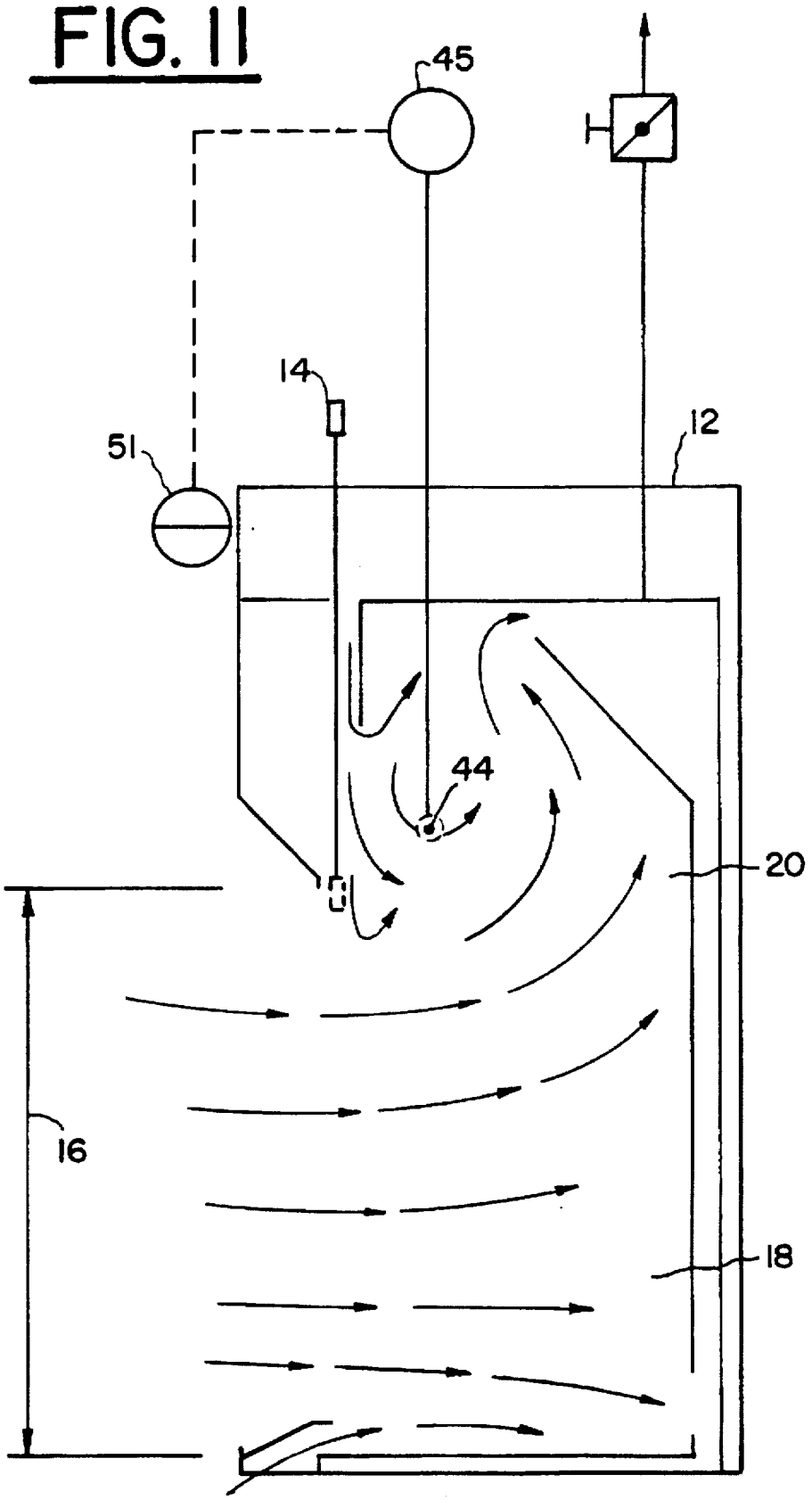

FIG. 10 is a schematic diagram of an adaptive gain controller for translating input signals from the vortex pressure transducer into output signals to the fume hood baffle adjustment servo and the exhaust damper; and FIG. 11 is a schematic vertical cross-sectional view of a hood equipped with a fume hood performance alarm including a vortex pressure sensor and transducer in accordance with the invention.

Figure 1:
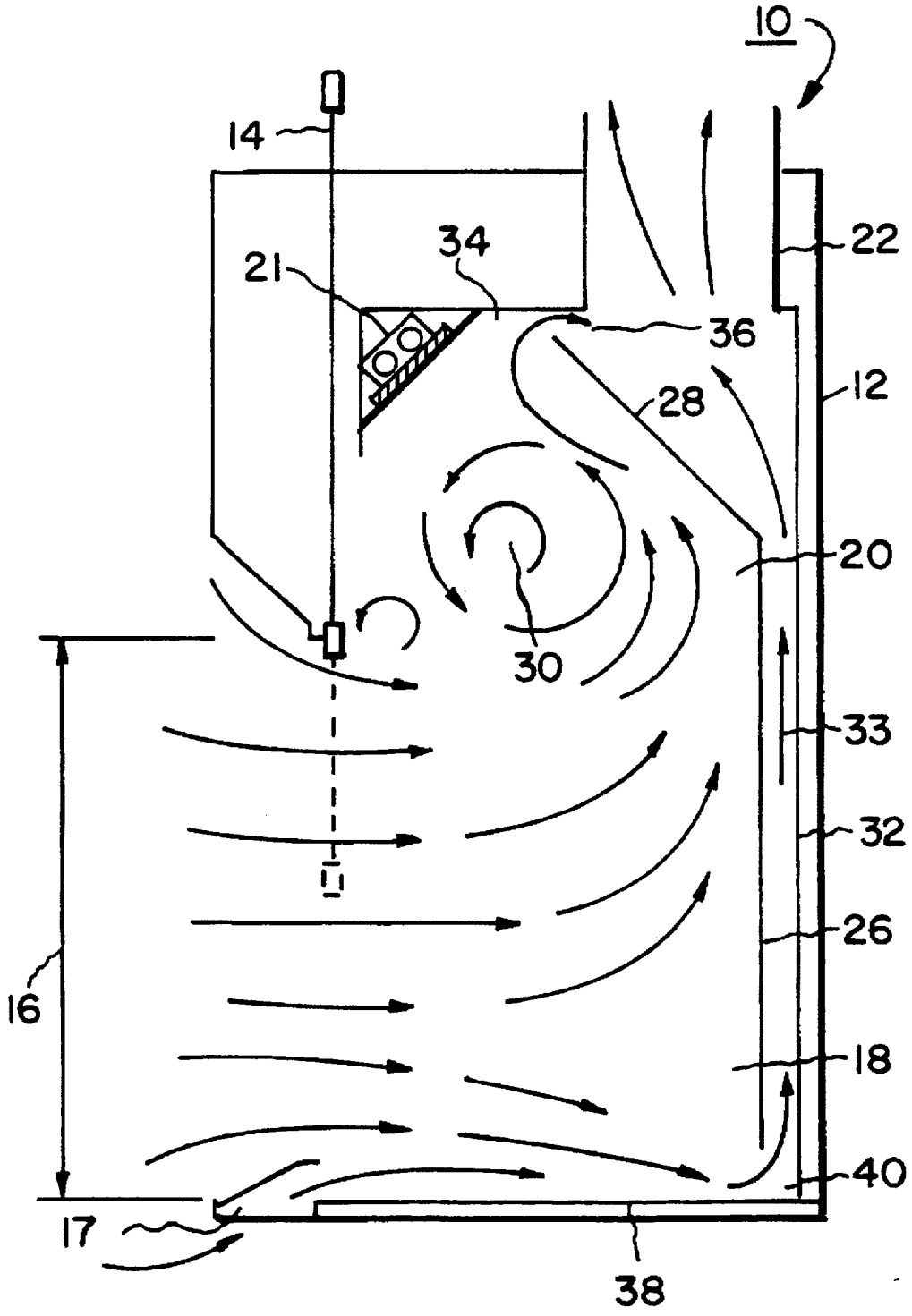
FIG. 1 (PRIOR ART)
FIG. 1 is a vertical cross-sectional view of a prior art hood without sensing and active control of the vortex.

Referring to FIG. 1, there is shown a typical prior art fume hood 10 having a housing 12 containing various elements for controlling or directing the movement of air into, within, and out of the hood. A vertically slidable door or sash 14 can variably expose an opening or face 16 for access of operators and air to the hood. The interior of the hood includes a working chamber 18 and above it a vortex chamber 20, and may include a work light 21. An exhaust stack 22 is provided with a fan 24 (not shown in FIG. 1) which draws air into the hood through face 16 and floor sweep entrance 17 and expels it through an opening in housing 12. Air flowing through the hood enters predominately through face 16, flows toward rear baffle 26 and upward to angled baffle 28 which assists in rolling the air flow into a cylindrical vortex 30. To provide for a hood floor sweep, the hood has a second air flow path. Baffles 26 and 28 are spaced apart from the rear wall 32 to form a conduit 33, also from top 34 to form exit slot 36 from vortex chamber 20, and from bottom 38 to form bottom slot 40. Baffle 26 may also have an intermediate slot 42 into conduit 33.

Figure 2:
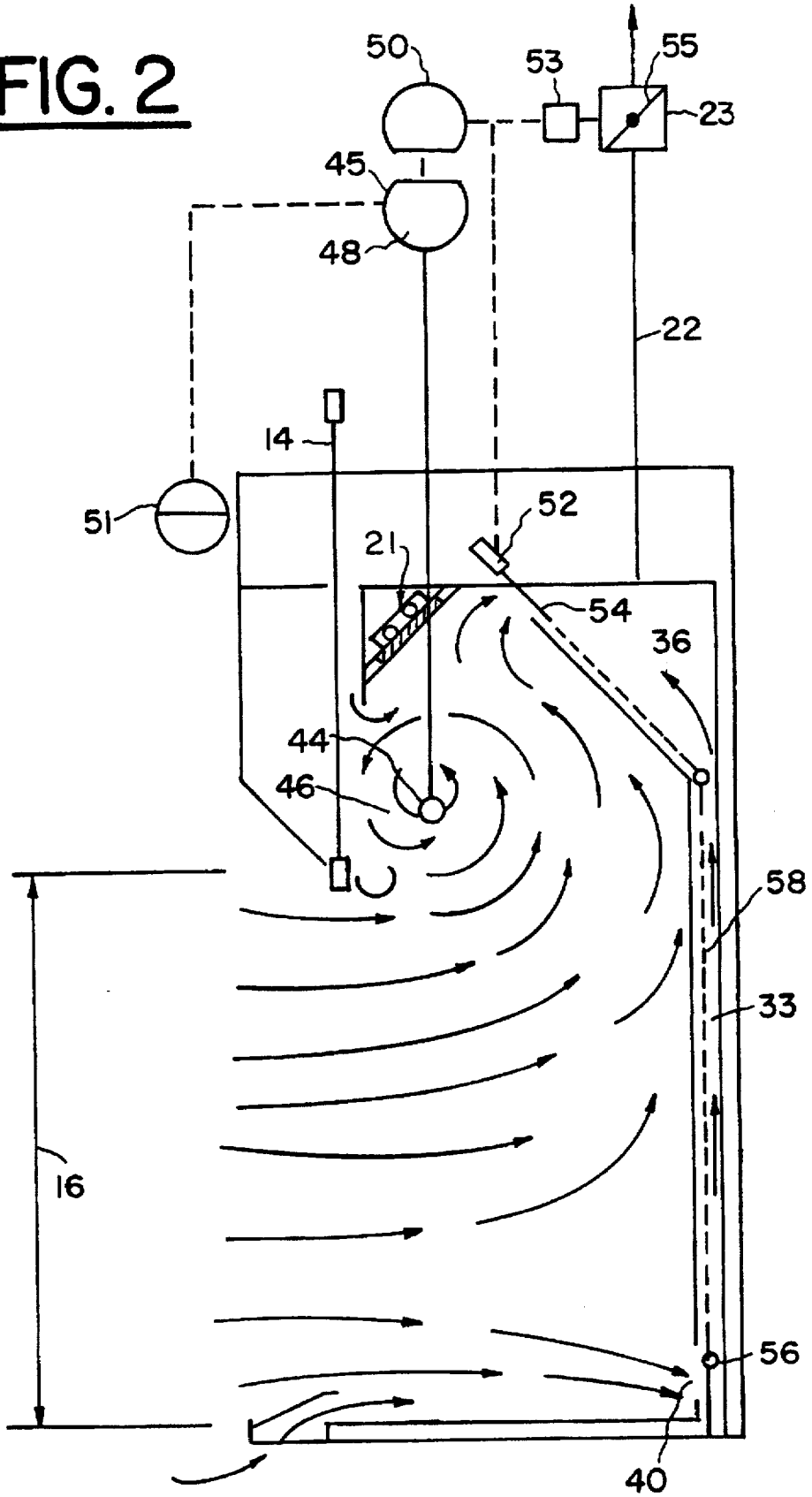
FIG. 2 is a vertical cross-sectional view like that of FIG. 1 showing vortex sensing and control elements in accordance with the invention.
Figure 9:
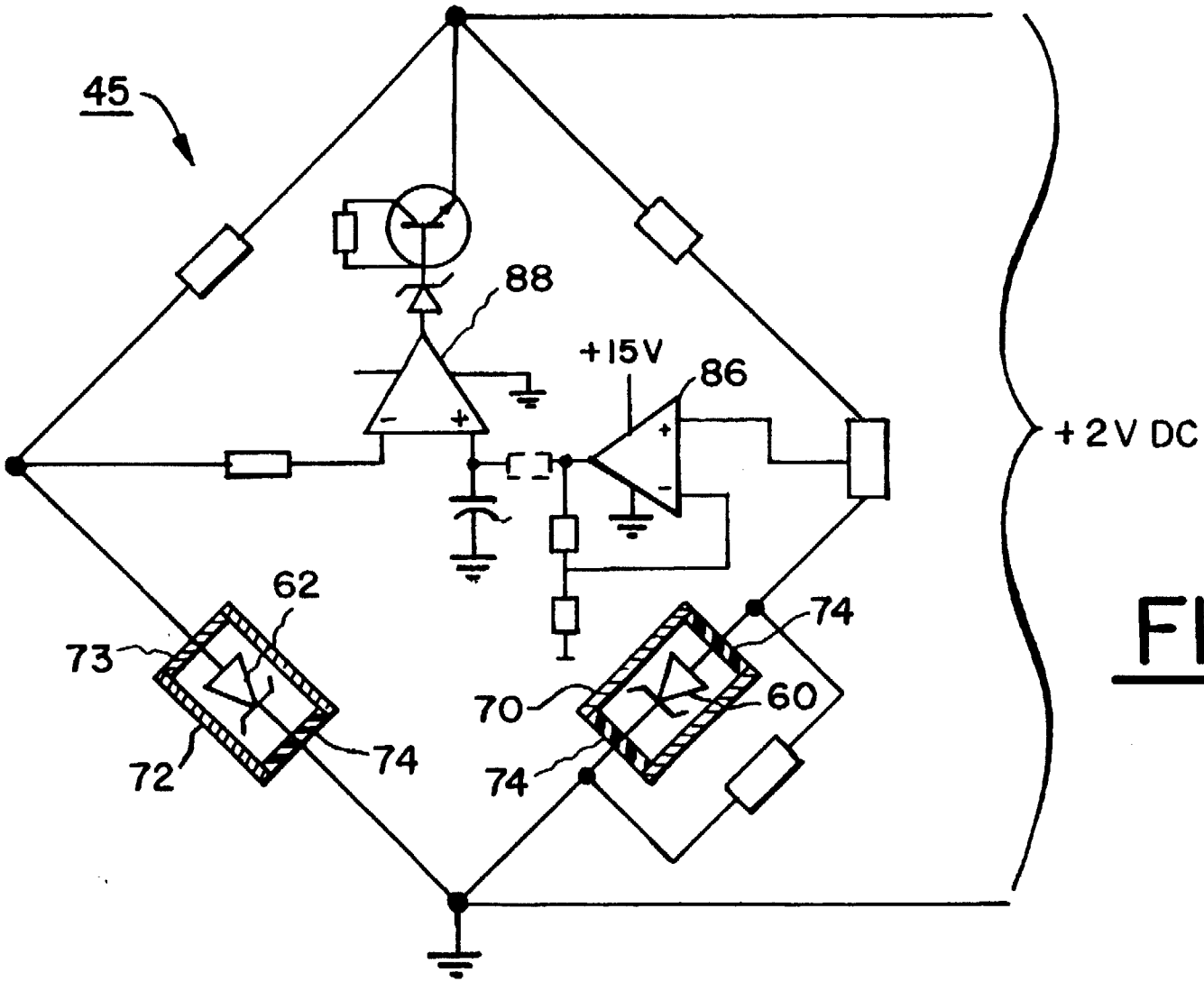
FIG. 9 is a schematic diagram of a dynamic vortex pressure transducer including the sensors shown in FIGS. 4 and 6.

FIG. 2 shows hood 10 modified in accordance with an embodiment of the invention. The sensing stage 44 of a dynamic differential pressure transducer 45 comprising a matched pair of thermal Zener diodes in opposite legs of an electronic bridge, described in more detail hereinbelow and shown in FIG. 9, is disposed outside a port in hood sidewall 46 to sense minute variations in air flow through the port resulting from minute variations in pressure within the vortex chamber, indicative of turbulence. Turbulence represents an unstable and undesirable condition in which the vortex is either absent or imperfectly formed and fumes are likely to escape through the face of the hood. When such variations are sensed, a signal resulting from a thermally-induced electrical imbalance between the diodes is sent to the second stage 48 of the transducer which includes a signal amplifier and is preferably located outside the hood. The real-time amplified signal is sent to a feedback controller 50, preferably an analog computer shown schematically in FIG. 10, having proportional integral and adaptive gain algorithms. The signal may also be sent to an alarm 51, which may have variable threshold discriminators to provide predetermined alarm limits. The output of controller 50 is sent to an actuator 52, preferably a servo stepping DC motor actuator, which moves an exit slot damper 54 and a bypass damper 56 synchronously via a connecting chain or cable 58. To admit more air to the vortex, bypass damper 56 is moved to further restrict bypass air passing through bottom slot 40, and exit slot damper 54 is moved to further open exit slot 36. Conversely, to reduce air flowing into the vortex, the bottom slot is opened to bypass air through conduit 33 and exit slot 36 is restricted. The system seeks a null in variation in the signal from sensor 44, indicating that a stable vortex exists in the vortex chamber. If no null is obtainable, the system infers that the total air flow through the hood is incorrect and signals a second actuator 53 to move a throttle damper 55 in the exhaust stack to change the total throughput.

Figure 3:
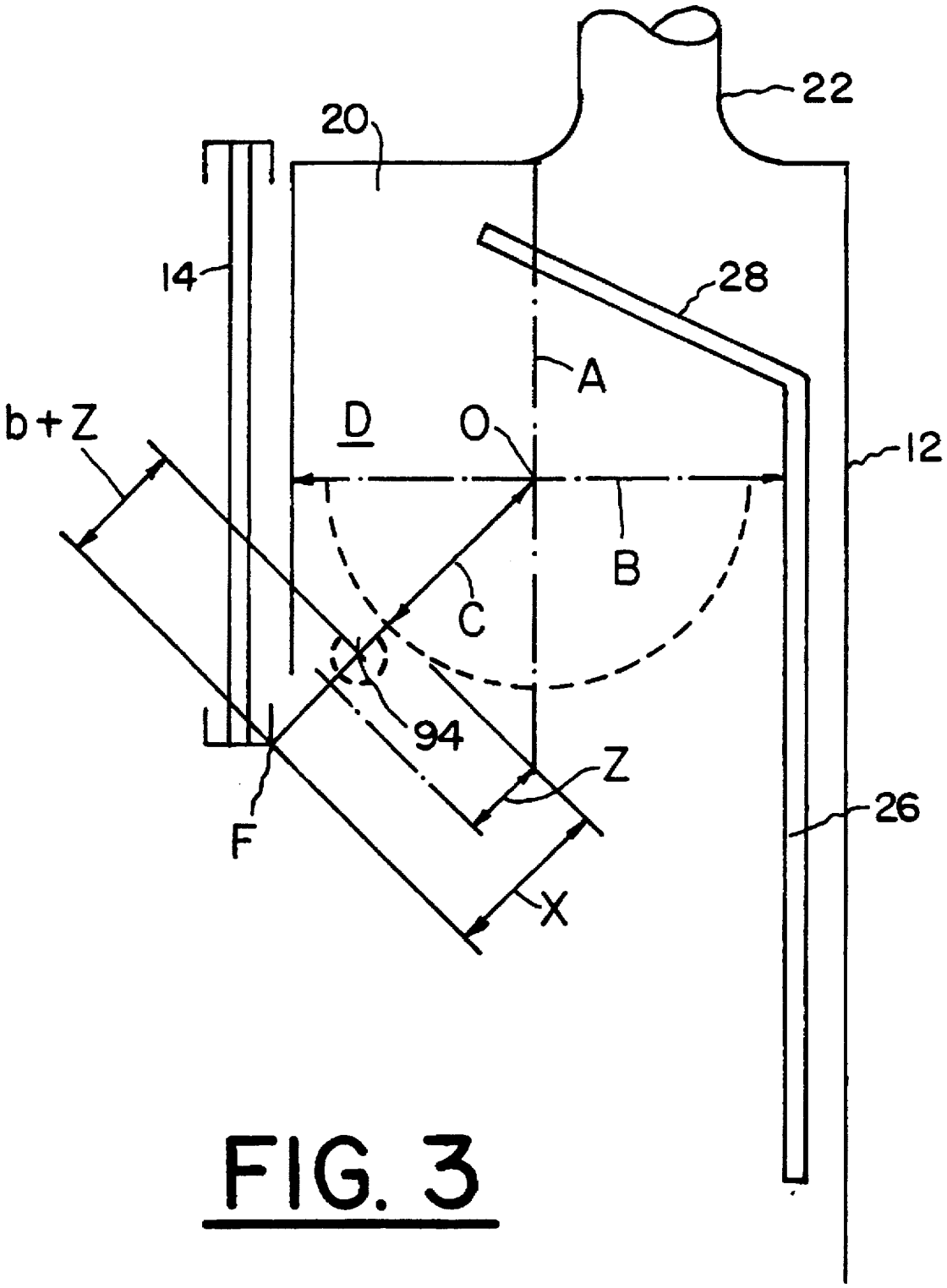
FIG. 3 is a schematic cross-section of a fume hood vortex chamber, illustrating the correct placement of the vortex pressure sensor.

The correct location for the pressure sensor in the hood sidewall may be determined for any hood, as shown in FIG. 3 and according to the following procedure:

First, seal all entrances to the hood, such as the floor sweep bypass, so that only air passing through the face is admissible. Open the sash to its maximum open position.

Second, set the volume of hood exhaust to provide an average face velocity of 100 feet per minute by, for example, varying the speed of the exhaust fan or adjusting an exhaust damper.

Third, close the sash 50% and measure the average face velocity.

Fourth, divide the value obtained in step three into 100 to obtain a pure hood index number called $R^2$:

$$R^2=100 \text{ fpm/avg. face velocity fpm} \quad (1)$$

Fifth, determine the height A and the depth B of the vortex chamber at the midpoints of the top and front, respectively, and use them to calculate a radius C having origin O at the orthogonal intersection of A and B according to the equation:

$$C = \{\sqrt{(2.98 \times AB/\pi)}\}/2 \quad (2)$$

Sixth, measure the distance D from origin O to the upper edge of the face opening F, and substract C from this value to obtain X:

$$X=D-C \quad (3)$$

Seventh, taking Z=X/2, calculate a placement factor b according to the equation:

$$b=Z(R^2) \quad (4)$$

Eight, place the sensor at a distance (b+Z) along line D from opening F.

Figure 5:
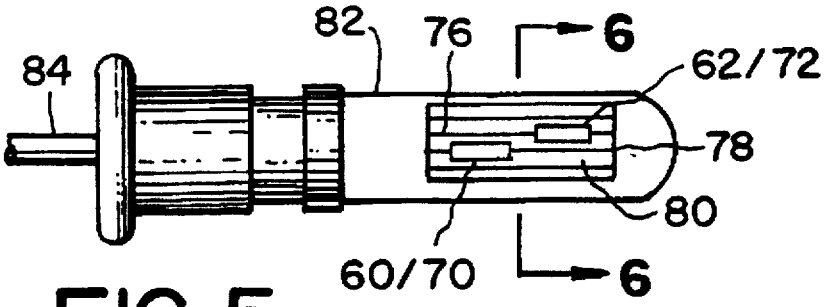
FIG. 5 is a plan view of the sensor.
Figure 4:
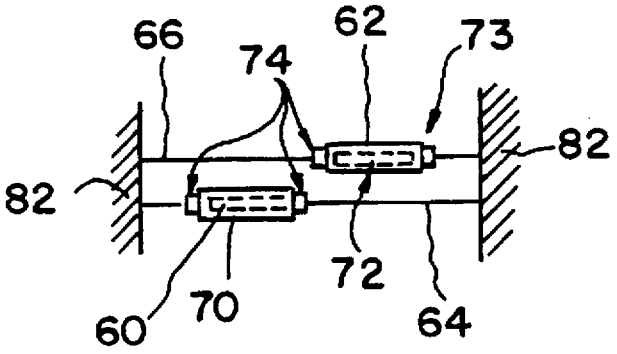
FIG. 4 shows the mounting of the thermal diodes in the sensor.
Figure 6:
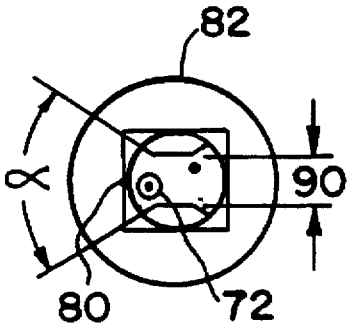
FIG. 6 is a cross-sectional view of the sensor taken along line 6—6 in FIG. 5.

Structure of the sensing element is shown in FIGS. 4–6. First thermal diode 60 and second thermal diode 62 are electronically identical in thermal response and are connected in respective legs 64 and 66 of electronic bridge 45 as shown in FIG. 9. Each diode is shielded by a length of thin-wall metal tubing 70 and 72, respectively, the shielding pieces being identical in size and material, for example, brass tubes 0.220 inches long by 0.094 inches OD having a wall thickness of 0.006 inches. Each tube is isolated from the diode by rubber spacers 74 to provide a uniform air gap between the sensor glass bead and the shielding tube. Diode 60 is the reference diode in the bridge. Tube 72 around diode 62 is mechanically attached as by soldering to the diode's anode lead, providing a mechanical heat sink 73 for diode 62 as the sensing diode, heat being dissipated more quickly from diode 62 than from diode 60. The balance current bridge tries to maintain a constant current through both legs of the bridge, but air passing across the diodes causes a resistance and current imbalance to occur, producing a carrier output signal from the bridge.

This mechanically-induced electrical upset provides several advantages. First, the mechanical imbalance never changes, and consequently there is no drift over time between the two sensors as may be experienced with known electronic imbalancing techniques. Second, the combination of linear thermal diodes with metal shield tubes provides high gain sensing at low temperatures, preventing the baking on of contaminants as can occur with hot-wire thermal resistance temperature devices. Third, the diodes used in this configuration can sense a pressure difference as low as 0.000015 inches of water column (wc) and deliver an amplified output voltage from the bridge of 2 volts DC.

The thermal diodes with their shields are mounted on their respective leads 76 and 78 in a window 80 in sensor housing 82. The leads are connected through cable 84 to the input leads of second stage 48 containing first and second amplifiers 86 and 88 and other known resistance elements of an electronic bridge. Preferably, the edges of the window are chamfered to provide an included entrance angle $\alpha$ of about 60°. Preferably, the throat 90 of the window is about 0.322 inches wide.

Figure 7:
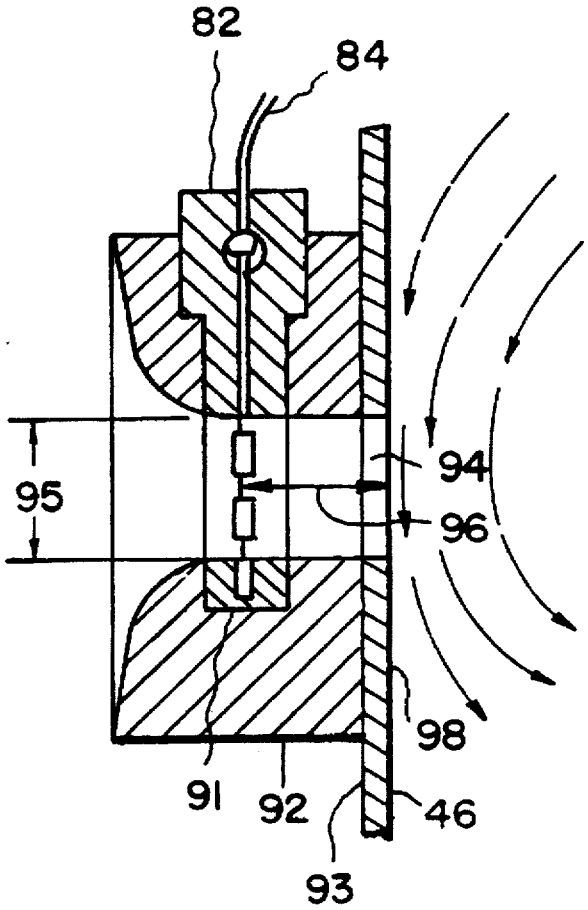
FIG. 7 is a cross-sectional view of the sensor mounted for operation in a nozzle element extending through the sidewall of the vortex chamber.
Figure 8:
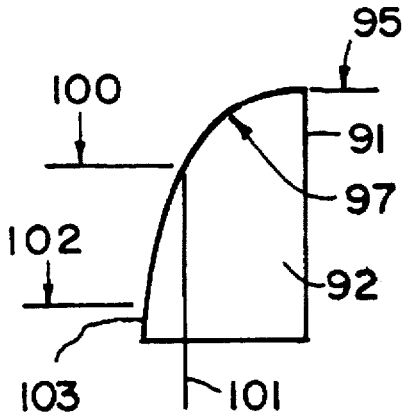
FIG. 8 is a cross-sectional view of the entrance curve of the nozzle shown in FIG. 7, showing dimensions which enable the nozzle to reject unwanted pressure waves from outside the vortex chamber.

As shown in FIGS. 7 and 8, sensor housing 82 is disposed in well 91 in mount 92 attached to the outer surface 93 of hood sidewall 46 adjacent to a port 94 in the sidewall. Preferably, mount 92 is substantially circular and surrounds port 94. Since noise in the form of pressure pulses originating outside the hood can be sensed by the diodes and can result in generation of false signals, mount 92 is preferably an annular nozzle which can effectively attenuate extraneous pulses from outside the hood. In a preferred embodiment, the diodes are located at a distance 96 between 0.2 inches and 3.4 inches from the inner surface 98 of sidewall 46 and port 94 has a diameter 95 of 0.690 inches. Beginning at the edge of well 91, the nozzle shape of mount 92 is curved outwardly at a radius of curvature 97 of 0.600 inches to a point at which the diameter 100 of the opening is 1.5 inches and the depth 101 of mount 92 to well 91 is 0.388 inches. Beyond diameter 100, the surface of the mount curves outwardly and defines a substantially parabolic-shaped entrance curve which replicates approximately a square root function of air flow vs. differential pressure over the fume hood anticipated operational pressure range to a diameter 102 of the opening of about 4 times diameter 95 and mount depth of 0.450 inches. Outboard of diameter 102 is a planar annular surface 103 0.031 inches wide and substantially parallel to sidewall 46.

Because the control of the fume hood vortex is a time-variant, nonlinear process, it is controlled in real time by use of an adaptive algorithm. The self-adaptive gain controller 50 shown in FIG. 10 compensates for various loop gains and takes the place of a human fume hood operator to make controller adjustments at different sash positions. The symbols in FIG. 10 are generally accepted designations for the components in controller 50 and describe the control algorithm. Either an analog (as shown) or digital control loop may implement the control algorithm. Analog control is preferred over digital because of speed of response.

The adaptive controller regulates system damping without upsetting the requirement of real time control. If the vortex is steady, no damping will be required and the proportional band is narrow. However, as disturbance is introduced, the band will widen by separating the deviation into frequency bands. If the oscillations are normal, they will pass through the high frequency channel. The signal is then rectified and the result sent to the positive and negative deviation adaptor. The integrator responds proportionally to the deviation by increasing the proportional band of the controller. Simultaneously, low frequency bands of deviation are amplified by gain K, rectified, and sent to the integrator. Any offset, drift, or sluggishness causes the integrator to decrease the controller proportional band to return the vortex to set point.

Vortex differential pressure transducer 45 may also be used as a component of a stand-alone hood alarm system, as shown in FIG. 11. For hoods not equipped with vortex control apparatus in accordance with the invention, it is important for operators to know when the hood is not in proper flow control and back-flow of fumes may occur. The output signal of transducer 45 may be sent directly to alarm 51 having a threshold discriminator to discriminate alarm signals from the carrier signal.

From the foregoing description it will be apparent that there has been provided improved apparatus and method to optimize dynamic fume containment in a hood, wherein differential pressure at a critical location in the vortex chamber is sensed and air flow through the vortex chamber is controllably varied to maintain a robust vortex. Variations and modifications of the herein described apparatus and method, in accordance with the invention, will undoubtedly suggest themselves to those skilled in this art. Accordingly, the foregoing description should be taken as illustrative and not in a limiting sense.

What is claimed is:

1. In a fume hood having a variable opening into a working chamber, a vortex chamber above the working chamber, and an exhaust system including a fan, a system for dynamically controlling the amount of air flowing through the vortex chamber by variably bypassing air through a conduit to the exhaust system, comprising:

a) a vortex differential pressure transducer;

b) an electronic controller for receiving amplified signals from said vortex differential pressure transducer, processing said signals, and providing controller output signals;

c) an actuator responsive to said output signals from said electronic controller; and d) a damper in said bypass conduit actuable by said actuator to vary the amount of air passing through said vortex by varying the amount of air passing through said bypass conduit to said exhaust system.

2. The system in accordance with claim 1 wherein said transducer comprises an electronic balancing bridge including a) a sensor for detecting variations in the pressure difference between the vortex chamber and the exterior of the hood, said sensor being disposed adjacent to a port through a wall of said vortex chamber, said port being located in a portion of the path of said vortex; and b) operational amplifiers for amplifying signals from said sensor.

3. The system in accordance with claim 2 further comprising a nozzle entrance at the exterior side of said port in said wall of said vortex chamber.

4. The system in accordance with claim 3 wherein said sensor comprises first and second thermally-responsive diodes disposed in the path of air flowing through said port into said vortex chamber, said diodes being connected by electrical leads into opposing legs of said electronic balancing bridge and being shielded respectively by first and second tubing shields insulated from said leads, said first shield being thermal-conductively attached to said first diode lead to form a heat sink from said first diode, said first diode being a signal diode and said second diode being a reference diode.

5. The system in accordance with claim 4 further comprising a sensor housing having a window wherein said diodes are disposed for exposure to air flowing through said port, said window having opposing entrance edges chamfered at an included entrance angle of about 60°.

6. The system in accordance with claim 5 wherein said nozzle is substantially annular, wherein said port has a diameter of about 0.7 inches, wherein said sensor housing is disposed in a well in said nozzle, and wherein the curvature of said annular nozzle has three regions, said first region beginning at the edge of said well and curving outwardly at a radius of curvature of about 0.600 inches to a point at which the diameter of the nozzle opening is about 1.5 inches and the depth of said nozzle to said well is about 0.388 inches, said second region curving outwardly from said first region in a substantially parabolic curve which replicates approximately the square root function of air flow vs. differential pressure over an operational pressure range to a point at which the diameter of the nozzle opening is about 4 times the diameter of said port and the depth of said nozzle to said well is about 0.450 inches, said third region extending outwardly from said second region and defining a substantially planar annular surface about 0.031 inches wide.

7. The system in accordance with claim 1 further comprising a second damper actuable by said actuator in opposite sense to said bypass damper, said second damper being disposed at an exit slot from said vortex chamber to said exhaust system to vary the open area of said exit slot.

8. The system in accordance with claim 1 further comprising a second actuator responsive to said output signals from said electronic controller and a third damper actuable by said second actuator and disposed in said exhaust system to throttle the throughput of said exhaust fan.

9. The system in accordance with claim 1 wherein the amplitude of said signals from said vortex differential pressure transducer is inversely proportional to the stability of said vortex, and said control system is a feedback control system which controllably varies the amount of air flowing through the vortex chamber to minimize said amplitude of said signals.

10. The system in accordance with claim 9 further comprising an alarm actuable by said differential vortex pressure transducer when said amplitude of said signals exceeds a predetermined limit.

11. The system in accordance with claim 1 wherein the optimum location for said port in said wall of said vortex chamber is at a distance (b+Z) from F along a line of length D between F and 0, where F is the location of the top of the face opening into the working chamber, O is the orthogonal intersection of the height A and depth B of the vortex chamber at the midpoints of the top and front, respectively, and where $C=\{\sqrt{(2.98\times AB/\pi)}\}/2$=a radius in a vertical plane from O, $X=D-C$ along line D, $Z=x/2$, $b=Z(R^2)$ and $R^2$=air velocity of 100 feet per minute through the wide-open face of the hood divided by the average air velocity with the open face area reduced to 50%.

12. The system in accordance with claim 1 wherein said electronic controller uses programmed proportional integral and adaptive gain algorithms in processing said signals.

13. The system in accordance with claim 11 wherein said electronic controller is an analog computer.

14. A method for optimizing the performance of a fume hood having a vortex chamber above a working chamber by dynamically optimizing the stability of a vortex in the vortex chamber, comprising the steps of:

a) determining the variation in differential pressure between the interior and the exterior of said vortex chamber at a location on the chamber sidewall exposed to said vortex, and b) varying the flow of air through said working chamber into said vortex until said differential pressure variation reaches a minimum.

* * * * *